US007312758B2

(12) United States Patent
Seybold

(10) Patent No.: US 7,312,758 B2
(45) Date of Patent: Dec. 25, 2007

(54) DUAL GAIN HANDHELD RADIO ANTENNA

(75) Inventor: John S. Seybold, Malabar, FL (US)

(73) Assignee: Harris Corporation, Melbourne, FL (US)

( * ) Notice: Subject to any disclaimer, the term of this patent is extended or adjusted under 35 U.S.C. 154(b) by 60 days.

(21) Appl. No.: 11/397,280

(22) Filed: Apr. 4, 2006

(65) Prior Publication Data

US 2007/0229389 A1 Oct. 4, 2007

(51) Int. Cl.
*H01Q 1/24* (2006.01)

(52) U.S. Cl. ..... 343/702; 343/895; 343/900

(58) Field of Classification Search ..... 343/702, 343/895, 900, 901, 850, 860
See application file for complete search history.

(56) References Cited

U.S. PATENT DOCUMENTS 5,825,330 A * 10/1998 Na et al. ..... 343/702
5,945,953 A * 8/1999 Tsuda et al. ..... 343/702
6,057,807 A * 5/2000 Marthinsson et al. ..... 343/895
2005/0245228 A1* 11/2005 Candal et al. ..... 455/347

* cited by examiner

*Primary Examiner*—Tho Phan
(74) *Attorney, Agent, or Firm*—Darby & Darby PC; Robert J. Sacco

(57) ABSTRACT

The present invention concerns a dual gain antenna system 100 with an integrated system to control a matching network 214. The dual gain antenna system 100 comprises an antenna that includes a first helically shaped antenna element 104, a second vertical antenna element 106, and a base portion 101. The first antenna element 104 is disposed around a longitudinal axis of a dielectric rod 102 that contains a bore 205. The second antenna element 106 is disposed within the longitudinal axis of the dielectric rod bore 205. A sensor 215 detects when the second antenna element 106 is in the extended position and transmits a control signal to a matching system 214 that selectively controls the impedance matching network 214 between the antenna and the RF feed line 103.

13 Claims, 5 Drawing Sheets

DUAL GAIN HANDHELD RADIO ANTENNA

BACKGROUND OF THE INVENTION

1. Statement of the Technical Field

The inventive arrangements relate to a dual gain radio antenna, particularly for handheld use.

2. Description of the Related Art

In the area of handheld radio communications, a task often faced by RF antenna designers is to provide an antenna that offers sufficient antenna gain without sacrificing operating bandwidth. To achieve such a two-fold objective, a physically large antenna has often been required. Examples of conventional solutions to this problem include various types of antenna devices such as fold-out crossed dipole antennas and dish antennas.

While such antennas are capable of providing enough gain in a particular radiating direction, their large and bulky design hinders their application for handheld use. In the area of military operations, for instance, there is a present need for both ground and satellite communications. Providing such dual use within a handheld device while maintaining a rugged low-profile design can be difficult.

Satellite communication devices typically require a high gain. Ground communications, on the other hand, do not necessarily require such high gain. It is well known in the art that different antennas or combination of antennas may have different load impedances. It is also known that impedance matching circuits are commonly implemented to facilitate the maximum amount of signal power transfer between an antenna and a transceiver.

Therefore, what is needed is a handheld radio antenna that can satisfy both satellite and ground communication antenna gain requirements. Such a device should be low-profile in design and include a control means for selectively providing the correct impedance matching network depending on what type of antenna (and hence communication use) is required.

SUMMARY OF THE INVENTION

The invention concerns a dual gain radio antenna. The antenna can include a dielectric rod having an internal bore axially disposed within the rod along a longitudinal axis. The rod can be made of a flexible material. A first antenna element can include a helically shaped conductor disposed around the longitudinal axis and supported by the dielectric rod. A second antenna element can include an elongated conductor disposed within the bore. The second antenna element can be a whip antenna element and can be movable between a retracted position and an extended position. The movement between retracted and extended positions is such that a larger length of the elongated conductor can extend from the bore when the second antenna element is in the extended position as compared to the retracted position.

A sensor can detect when the second antenna element is in the extended position. The sensor can be a switch. A matching system can be responsive to the sensor. The matching system can selectively control an impedance matching circuit for the antenna. A contact element can be disposed on a portion of the second antenna element and positioned to form an electrical connection between the first and second antenna elements when the second antenna element is in the extended position.

The antenna can have a first electrical length when the second antenna element is in the retracted position and a second electrical length when the second antenna element is in the extended position. The second electrical length is larger than the first electrical length. According to one aspect of the invention, the first electrical length can be a multiple of 0.25 wavelength and the second electrical length can be a multiple of 0.5 wavelength. However, the invention is not limited in this regard and the antenna can be of any electrical length. The antenna can have a higher gain when the second antenna element is in the extended position as compared to when the second antenna is in the retracted position.

A portion of the second antenna element can engage the switch to automatically transfer the switch from a first position to a second position when the second antenna element is moved between the retracted and extended positions. The matching system can couple a first impedance matching network to the antenna when the second antenna element is in the retracted position. In the extended position, the matching system can couple a second impedance matching network to the antenna. In one alternative, the matching system can modify the first impedance matching network to provide the second impedance matching network. The impedance matching network can be connected to a feed line of the antenna located substantially at a base of the helically shaped conductor.

According to another embodiment, the antenna can include first and second elongated elements. The second elongated element can be disposed within the axial bore of the first elongated element and can be movable between a retracted position and an extended position. A larger length of the second elongated antenna element can extend from the bore when the second antenna element is in the extended position as compared to the retracted position. The antenna can further include a switch that is disposed on a portion of the antenna. The switch can change states when transferred from a first switch position to a second switch position when the second antenna element is moved between the extended position and the retracted position. A matching system responsive to the switch can selectively control an impedance matching circuit for the antenna. The impedance matching circuit can provide an impedance match between the antenna and a transceiver. A contact element can be disposed on a portion of the second elongated antenna element. The contact element can be positioned to form an electrical connection between the first and second elongated antenna elements when the second elongated antenna element is in the extended position.

DETAILED DESCRIPTION OF THE PREFERRED EMBODIMENTS

Figure 1:
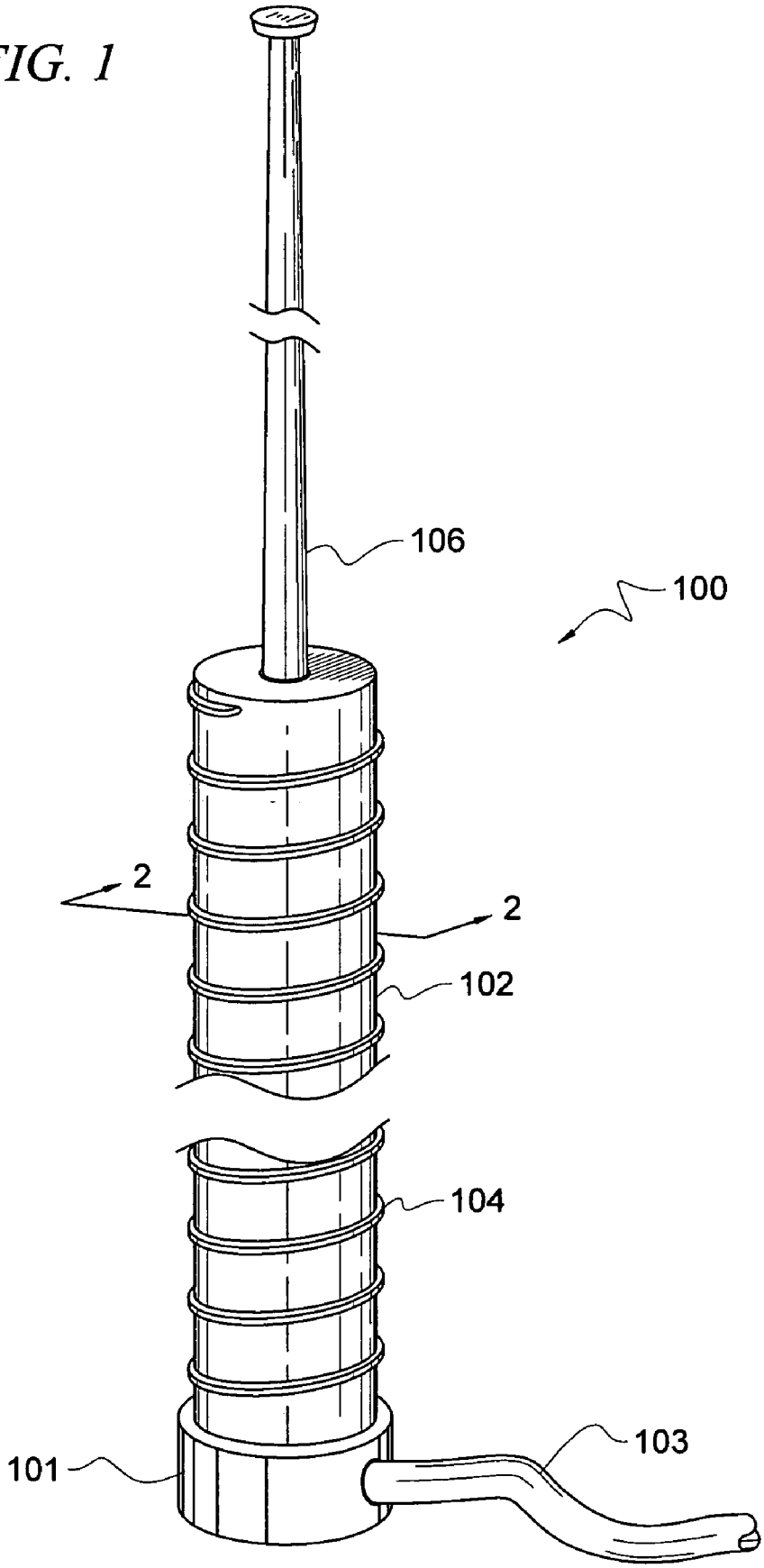
FIG. 1 is a perspective view of an antenna system that is useful for understanding the invention.

The present invention concerns a dual gain antenna system with an integrated system to control a matching network. Referring to FIG. 1, the dual gain antenna system comprises an antenna that includes a first antenna element 104, a second antenna element 106, and a base portion 101. The first antenna element 104 can be disposed around a longitudinal axis of a dielectric rod 102. The second antenna element 106 can be aligned with the longitudinal axis and supported by the dielectric rod 102. For example, the second antenna element can be axially positioned within the dielectric rod 102. The base portion 101 of the antenna system 100 can be electrically connected to an RF feed line 103.

The first antenna element 104 can be comprised of a helically shaped conductor. The helically shaped conductor can be made from conductive material such as copper and aluminum. However, the invention is not limited to these metals and other conductive materials can also be used. The first antenna element 104 is preferably wrapped around the exterior of the dielectric rod 102. A resin coating (not shown in FIG. 1) can be applied to the exterior of the dielectric rod 102 to protect and secure the first antenna element 104 to the dielectric rod 102. Alternatively, the first antenna element 104 can be disposed within the dielectric rod 102 (not shown in FIG. 1).

The first antenna element 104 can have a multitude of electrical lengths. Typically, this electrical length can be a multiple of 0.125 or 0.25 wavelength. However, those skilled in the art will appreciate that the invention is not limited in this regard. As shown in FIG. 1, the first antenna element 104 can be wound around the dielectric rod 102. In general, the coil diameter of the windings defined by the first antenna element should be much smaller than one wavelength at the designed operating frequency of the antenna. The foregoing arrangement is sometimes referred to as a helically loaded vertical antenna. In any case, the helical winding causes the first antenna element to have a slightly increased inductance as compared to an ordinary base loaded vertical antenna. The radiation pattern of the antenna with the helical winding would, in effect, resemble that of a vertical antenna However, the helically loaded vertical antenna element will tend to be slightly less efficient as compared to a conventional whip antenna of equivalent electrical length. It is also important to note that the distributed loading produced by the helical winding of the first antenna element will allow it to be considerably shorter in physical length as compared to a conventional vertical antenna formed of a linear conductive element. Techniques for designing and manufacturing helically loaded vertical antennas as described herein are well known in the art.

The dielectric rod 102, as the name suggests, is preferably cylindrical in shape. However, other shapes can be used, including but not limited to conical or cuboidal shapes. The dielectric rod 102 can be made of a flexible, low loss material having a relatively low permittivity. Examples include, but are not limited to PTFE (Teflon®), carbon dielectric foam, and plastics such as poly vinyl chloride (PVC).

The second antenna element 106 can be comprised of an elongated conductor that can be made of a rigid or flexible conductive material. For example, the conductive material can be copper, aluminum or other metal alloy. A whip antenna can be preferably used for its flexibility and economical design. In FIG. 1, the second antenna element 106, is shown in its extended position. As with the first antenna element, the second antenna element 106 can also be designed for a variety of electrical lengths. A typical electrical length that can be used for the second antenna element 106 can be a multiple of 0.125 or 0.25 wavelength. However, those skilled in the art will appreciate that the invention is not limited in this regard and the second antenna element 106 can be of any electrical length.

The base portion 101 is attached at the base of the dielectric rod 102. In FIG. 1, the base portion 101 appears as having a cylindrical shape. Alternatively, the cylindrical base portion 101 can form an extension of the dielectric rod 102. In this regard, it should be understood that the base portion 101 can be integrally formed with the dielectric rod 102. Moreover, other shapes may be used for the base portion 101 including, but not limited to, a rectangular boxed shape. The RF feed line 103 can be provided for communicating RF energy to and from the antenna 100. According to one aspect, a feed point of the antenna can be a portion of the first antenna element at a location near the base portion 101. In this regard, it can be convenient for the RF feed line to connect to the antenna 100 at the base portion 101. Examples of possible RF feed lines include, but are not be limited to, coaxial cables, microstrip, and stripline feeds.

As an alternative to the RF feedline 103 extending from the base portion 101, the antenna signal from the matching network 214 can instead be transmitted directly to an RF connector mounted on the base portion 101 of antenna 100. Any suitable RF connector can be used for this purpose. Typical RF connector types include, but are not limited to BNC, C, GR, F, IEC 169-2, N, TNC, UHF, DIN 47223, MCX, FME, SMA, SMB, SMC, and APC-7 connector types. The RF connector can mate with a corresponding electrical connector mounted on a portable radio.

Similar to the dielectric rod 102, the base portion 101 can also be made of a flexible, low loss material having a relatively low permittivity. Examples include, but are not limited to PTFE (Teflon®), carbon dielectric foam, and plastics such as poly vinyl chloride (PVC). As noted above, the base portion 101 can be integrally formed with the dielectric rod 102.

Figure 2:
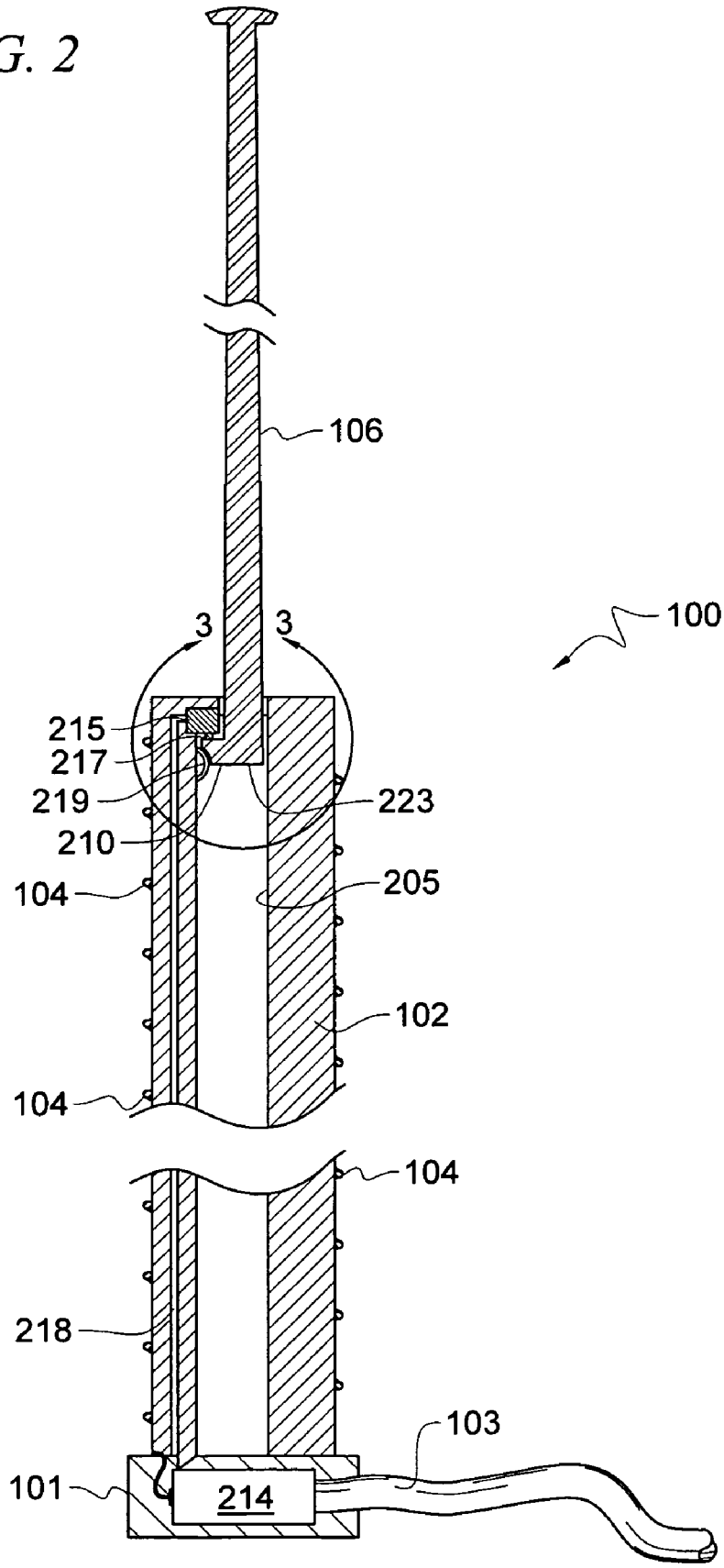
FIG. 2 is a cross-sectional view of the antenna in FIG. 1 defined by the line 2-2.
Figure 5:
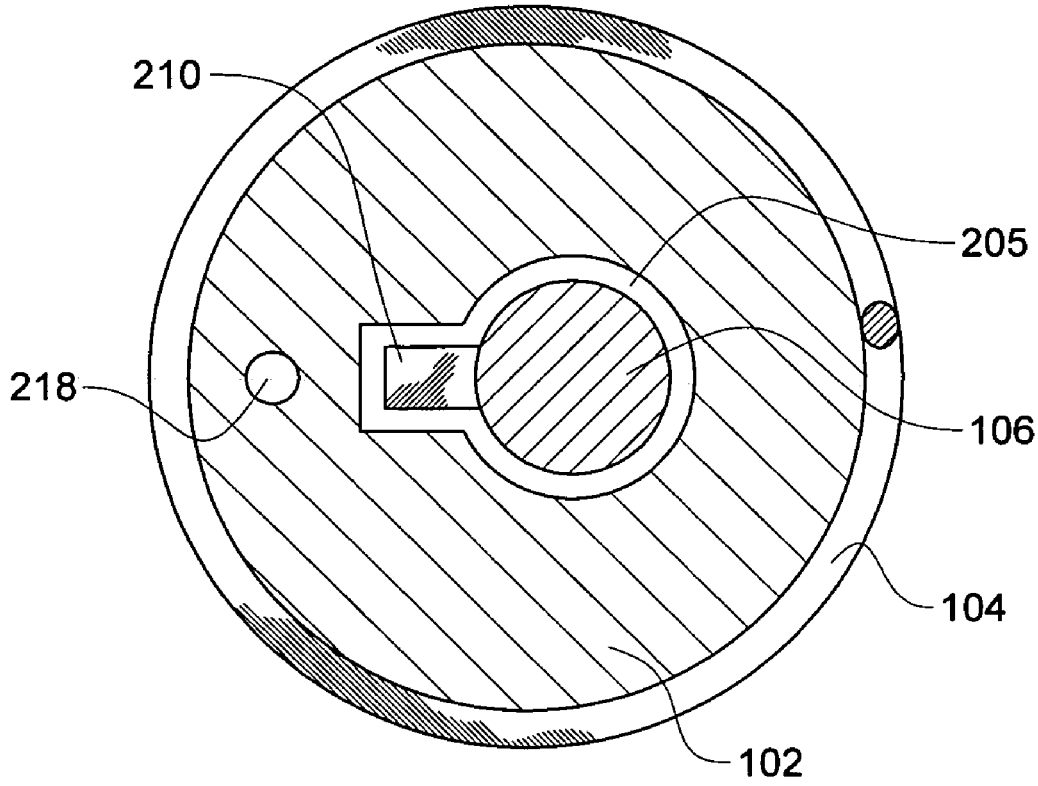
FIG. 5 is a cross-sectional view of a portion of the antenna system in FIG. 4 defined by the line 5-5.

Referring now to FIG. 2, there is shown a cross-sectional view of FIG. 1. FIG. 2 illustrates additional structural detail regarding the first antenna element 104, second antenna element 106, and the base portion 101. The dielectric rod 102 can have an internal bore 205 that is axially disposed therein along the rod's longitudinal axis. As shown in FIG. 2, the bore 205 may be disposed along the center of the rod. However, the bore 205 can also be disposed off-center. FIG. 5 shows further detail of the bore 205 profile configuration.

Figure 4:
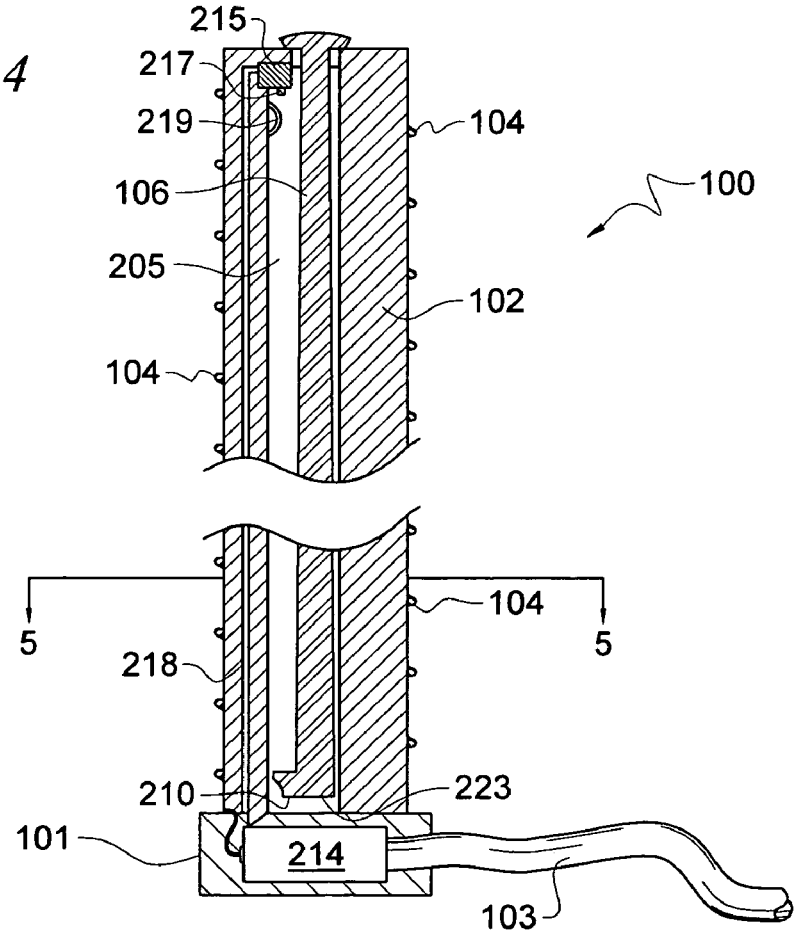
FIG. 4 is a cross-sectional view of FIG. 1 defined by the line 2-2 showing a second antenna element in a retracted position.

The second antenna element 106 can be disposed within the bore 205. The second antenna element 106 is placed in this configuration such that it is movable between a retracted position and an extended position. In FIGS. 1 and 2, the second antenna element 106 is shown in its extended position. In FIG. 4, the second antenna element 106 is shown in its retracted position. It can be seen that a larger length of the second antenna element 106 extends from the bore 205 in the extended position as compared to when the second antenna element is in its retracted position.

The cross-sectional view of FIG. 2 also reveals additional structures within the dielectric rod 102 and base portion 101. A sensor 215 can be disposed within the dielectric rod 102. Sensor 215 can be any device capable of detecting a position of the second antenna element. For example the sensor can detect when the second antenna element 106 is in its extended position shown in FIGS. 1 and 2. A resilient member 219 can also be provided within the bore 205. The resilient member can be any suitable structure or mechanism arranged to releasably engage and secure the second antenna element in its extended position. A contact element 210 can be disposed on a portion of the second antenna element 106 for providing a point at which electrical contact can be established between the first and second antenna elements. Finally, a coupling channel 218 can be disposed along the longitudinal axis of the rod 102. The coupling channel can be used for communicating information from the sensor 215 to a matching system 214 shown disposed within the base portion 101.

The foregoing components can be arranged in any suitable manner to perform three basic functions when the second antenna element 106 is in its extended position. These three functions include (1) releasably securing the second antenna element 106 in its extended position, (2) forming an electrical contact between an upper portion of the first antenna element 104 and a lower portion of the second antenna element 106, and (3) communicating a control signal to the matching system 214 to identify a position of the second antenna element. FIGS. 2-5 illustrate one possible example of the manner in which the foregoing functions can be implemented. Those skilled in the art will appreciate that there are many possible arrangements and structures that can be devised for accomplishing the foregoing and the invention is intended to include all such variations. Accordingly, the invention is not limited with regard to the specific arrangements shown.

Figure 3:
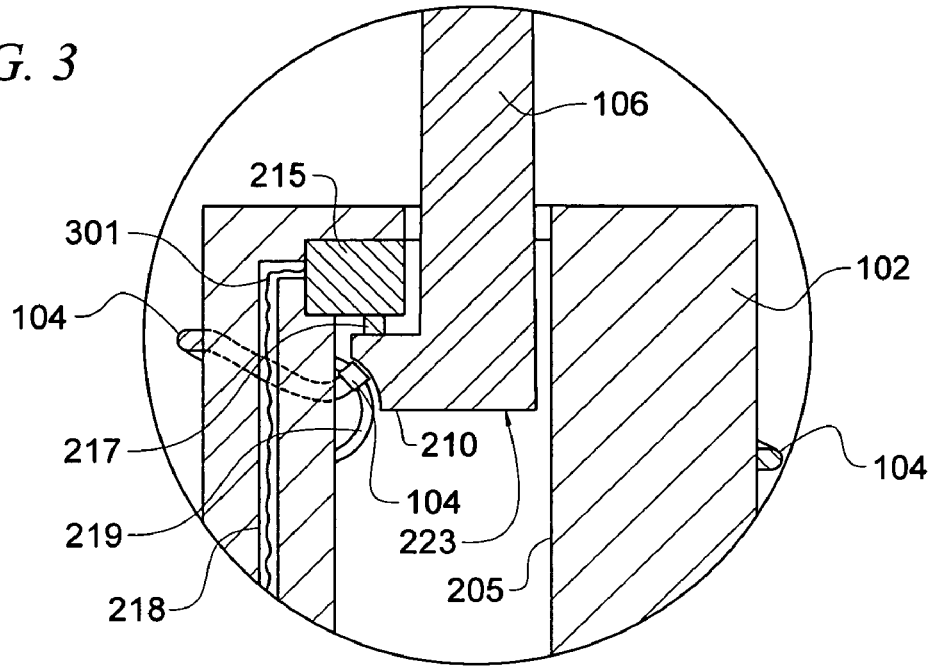
FIG. 3 is an enlarged view of a portion of the antenna in FIG. 2 defined by the line 3-3.

FIG. 3 shows an enlarged view that is useful for understanding the physical interaction between one possible embodiment of the aforementioned structures. The sensor 215 is designed to detect a position of the second antenna element. For example, the sensor 215 can be arranged to detect when the second antenna element 106 is in its extended position. The sensor 215 shown in FIG. 3 is a push-button switch, whereby the push-button 217 is pressed when the second antenna element 106 is in the extended position. Mechanically, the contact element 210 engages the push-button 217 once the contact element 210 is lockingly engaged with the resilient member 219. Although FIG. 3 shows the sensor 215 disposed near the top of the dielectric rod 102, the sensor 215 can be placed in other locations either inside or outside of the dielectric rod 102, provided that it is capable of detecting when the second antenna element is in its extended position and that it does not alter the RF properties of the antenna system 100.

It should be noted that the sensor 215 need not be a push-button switch. For example, a leaf switch could also be used for this purpose. Other alternative types of sensors can also be used to detect when the second antenna element 106 is in the extended position. For example, any suitable electronic, magnetic or optical sensor can be used for this purpose. All that is necessary is that the sensor 215 be capable of detecting when the second antenna element 106 is in its extended position, and generating a control signal to communicate the occurrence of that condition.

In FIG. 3, the resilient member 219 serves as a detent mechanism that releasably engages contact element 210. When the second antenna element 106 is moved toward its extended position, the contact element 210 slides up and over resilient member 219. While this action is occurring, resilient member 219 flexes away from contact element 210. When the second antenna element reaches its extended position, the contact element will flex back toward the contact member and lock the second antenna element in position. The second antenna element can be returned to its retracted position by applying a sufficient force urging the second antenna element 106 back into the bore 205. In this regard, the detent mechanism can releasably secure the second antenna element 106 in its extended position.

According to one embodiment, the resilient member 219 can also form a part of sensor 215 for purposes of detecting the position of the second antenna element. For example, the conductive resilient member 219 could be a part of a leaf spring used to activate the sensor 215.

The resilient member 219 can engage the contact element 210 disposed on a bottom portion of the second antenna element 106 when the second antenna element 106 is in the extended position. As shown in FIG. 3, the contact element 210 may be notched to facilitate the locking engagement of resilient member 219. The resilient member 219 can preferably be a leaf spring made of a conductive material. The conductive material can include, but is not limited to copper, aluminum or other highly conductive metal alloys.

According to one alternative (shown in FIG. 3), the resilient member 219 can be electrically connected to a portion of the first antenna element 104 opposed from the base 101. Consequently, the second antenna element 106 can be electrically connected to the first antenna element 104 via the resilient member 219 when the second antenna element 106 is in the extended position. However, the coupling of the first and second antenna elements can also be achieved by direct contact between the two antenna elements. Those skilled in the art will appreciate that a variety of different structures could be used to form an electrical connection between the first antenna element and the second antenna element when the second antenna element is in the extended position. In this regard, it will be appreciated that the invention is not limited with regard to the particular means that are utilized for establishing the coupling of these elements.

By electrically coupling the first and second antenna elements, 104 and 106, the electrical lengths of both antenna elements 104, 106 in the extended position are combined. The additional length of the antenna provided in this way can be utilized to provide an antenna with a different gain pattern as compared to the first antenna element alone. For example, the combined antenna elements can have a larger gain in a particular direction as compared to the first antenna element 104 operated by itself. The second antenna element can be electrically isolated from the first antenna element when the second antenna element is in its retracted position and not in use.

The coupling channel 218 can be used for communicating control signals from the sensor to the matching system 214. Any suitable arrangement can be used for communicating such signals. According to one embodiment, the sensor 215 can be electrically connected to the matching system 214 via a wire 301 within the coupling channel 218, whereby the sensor 215 can send a signal to the matching system 214 when the second antenna element 106 is in the extended position. However, the invention is not limited in this regard. For example, the coupling channel 218 can also contain an optical or mechanical link for communication control signal data between the sensor 215 and the matching system 214.

The matching system 214 can be responsive to a control signal received from the sensor 215. Depending upon whether the second antenna element 106 is in a retracted or an extended position, the matching system 214 can selectively control an impedance matching circuit for the antenna system 100. When the second antenna element 106 is in an extended position, the overall antenna system 100 can have a different input impedance as compared to when the second antenna element is in the retracted position. Operating the antenna system 100 will typically require an impedance match between the input impedance at the antenna load (at the base of the first antenna element 104) and the output impedance at the feed line 103 for maximum RF energy/signal transfer. The matching system can automatically provide such impedance matching in response to a control signal received from sensor 215. Although the matching system 214 shown in FIG. 2 is disposed within the base portion of the antenna 101, it is not required to be positioned in such a manner. Alternatively, the matching system 214 may be disposed in other areas of the radio such as within the radio's casing.

FIG. 4 shows a cross-sectional view of FIG. 1 similar to that shown in FIG. 2 except that the second antenna element 106 is shown in its retracted position. This configuration shows how the second antenna element's 106 contact element 210 is disengaged from the resilient member 219. It also shows how the sensor's 215 push-button 217 is disengaged from the contact element 110, thereby electrically disconnecting the second antenna element 106 from the first antenna element 104.

When the second antenna element is in its retracted position, the antenna 100 will be comprised of only a single radiating member. In particular, only the first antenna element 104 will function as a radiating member under these circumstances. Since the second antenna element 106 is retracted and disposed between the coils of the first antenna element 104, the radiating antenna can display a radiation pattern that is essentially that of a helically loaded vertical antenna. However, the second antenna element may slightly modify the input impedance of the helically loaded first antenna element 104. Accordingly, it can be desirable to select the matching system 214 to ensure a high efficiency conjugate match to the feel line output impedance. For example, assuming that the electrical length of the helical antenna element 104 is a multiple of 0.25 wavelength, the overall antenna system 100 would operate as a monopole with an electrical length that is a multiple of 0.25 wavelength. Additionally, this shorter antenna system 100 will typically have lower gain.

Referring now to FIG. 5, the bore 205 profile configuration is illustrated in greater detail. The bore 205 can be sized and shaped such that it contains both the second antenna element 106 and the contact element 210. Although FIG. 5 shows the bore 205 to be of keyhole shape, other bore profiles are possible depending upon the physical size and shape of the second antenna element 106 and contact element 210. Moreover, the bore 205 should be of such profile that the second antenna element 106 cannot extend past the point in which the contact element 210 engages the push-button 217 (refer to FIG. 3).

Figure 6:
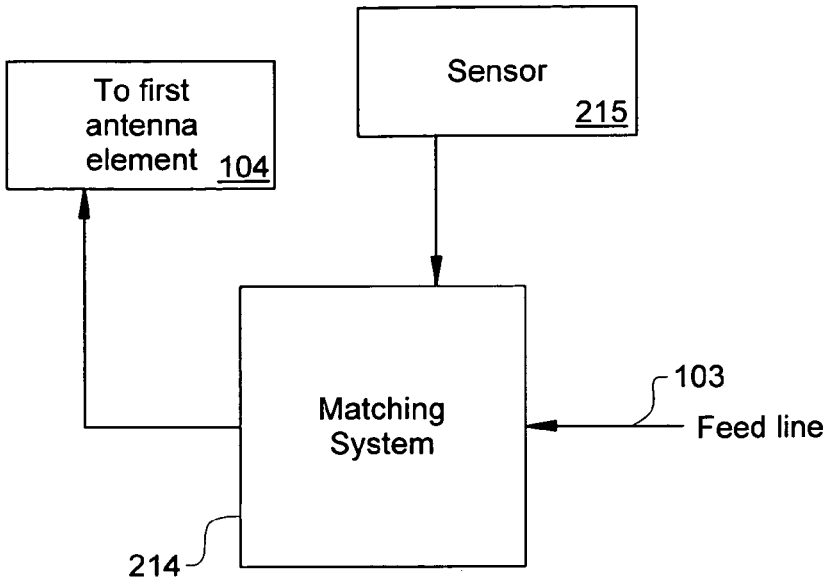
FIG. 6 is an electrical block diagram that is useful for understanding the general interaction of several components comprising the antenna in FIG. 1.

FIG. 6 shows an electrical block diagram of the general interaction between the sensor 215, the matching system 214, the first antenna element 104, and the RF feed line 103. Sensor 215 can detect when the second antenna element 106 is in the extended state. Under these circumstances, the sensor 215 can communicate a control signal to the matching system 214. In response to the control signal, the matching system 214 provides an effective matching circuit. According to one alternative, a first impedance matching circuit network may be modified to account for differences in the input impedance for antenna 100 when the second antenna element is in the retracted position versus the extended position. According to another embodiment, a first impedance matching network can be substituted for a second impedance matching network when the second antenna element is in the retracted versus extended position. Depending on the particular antenna design, a matching circuit may only be required when the second antenna element is in the retracted position or extended position. In that case, the matching network can bypass the matching network when it is not needed. In that case, the modified matching network would be comprised of the RF bypass circuit.

Figure 7:
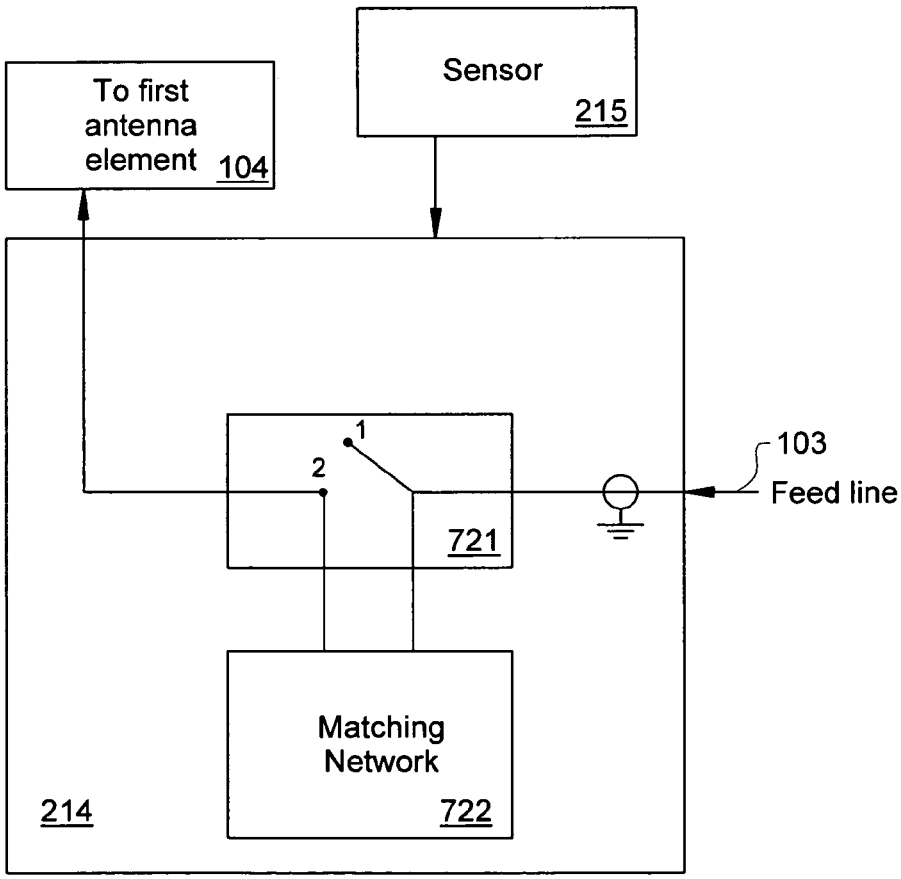
FIG. 7 is an electrical block diagram showing in greater detail one embodiment of the matching system from FIG. 6.

FIG. 7 shows an electrical block diagram that illustrates a more detailed interaction of the matching system 214, sensor 215, first antenna element 104, and feed line 103. In this regard, it should be understood that FIG. 7 merely represents one possible arrangement. Other circuit architectures can also be used for this purpose without limitation. In FIG. 7, the matching system 214 can be comprised of an RF relay system 721 that toggles between positions 1 and 2 depending upon whether the matching system 214 receives a control signal from sensor 215. For example, if the second antenna element 106 is in the extended position, the normally-closed (NC) relay 721 can be activated by a control signal from sensor 215 and can switch to position 1, an open state for the relay 721. Position 1 is used when the output impedance of the feed line 103 is matched to the antenna system 100 through a predetermined impedance matching network 722.

However, if the second antenna element is in the retracted position, the sensor 215 will not be activated and no control signal from the sensor will signal the matching system 214. The lack of a control signal will cause the relay 721 to toggle from position 1 to position 2, returning the relay to its normally-closed position. Position 2 is used when the output impedance of the feed line 103 is matched to the antenna system 100 without the need for a matching network 722. While FIG. 7 employs the use of a normally-closed relay, other circuit configurations may be adapted for use with a normally-open (NO) relay (i.e. normally in position 1 without electrical activation of the relay). In one embodiment, the matching system 214 can contain a relay 721 that is powered by a 24 VDC power supply. The DC voltage can be supplied by the transceiver (not shown) to which the antenna 100 can be connected. However, other types of electrical switching mechanisms can be employed.

The previously described versions of the present invention have many advantages. One advantage includes the ability to selectively match a known antenna's impedance with the known impedance at the RF feed line using a-predetermined impedance matching circuit. The correct impedance matching network 722 is provided automatically in response to a determination as to whether the second antenna element 106 is in an extended state or in a retracted state. The rugged compact design and whip configuration of antenna system 100 facilitates the use of the antenna for multiple gain configurations while the radio operator is "on the run." This holds a significant advantage over fold-out or dish antennas that are typically larger and more obtrusive in design and not as suitable for portable use.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A dual gain radio antenna, comprising a dielectric rod having an internal bore axially disposed within said dielectric rod along a longitudinal axis;

a first antenna element comprised of a helically shaped conductor disposed around said longitudinal axis and supported by said dielectric rod;

a second antenna element comprised of an elongated conductor disposed within said internal bore, said second antenna element movable between a retracted position and an extended position, a larger length of said elongated conductor extending from said bore when said second antenna element is in said extended position as compared to said retracted position;

a sensor disposed within said dielectric rod and configured to detect when said second antenna element is in said extended position;

a matching system and a relay controlling said matching system, all disposed within a portion of said dual gain radio antenna and responsive to said sensor, wherein said matching system includes an impedance matching circuit for said dual gain radio antenna;

a contact element disposed on a portion of said second antenna element and positioned to form an electrical connection between said first antenna element and said second antenna element when said second antenna element is in said extended position; and means for removably coupling said dual gain radio antenna to a portable communications device.

2. The dual gain radio antenna according to claim 1, wherein said antenna has a first electrical length when the second antenna element is in said retracted position, and a second electrical length when said second antenna element is in said extended position, and wherein said second electrical length is larger than said first electrical length.

3. The dual gain radio antenna according to claim 2, wherein said first electrical length is a multiple of 0.25 wavelength.

4. The dual gain radio antenna according to claim 2, wherein said second electrical length is a multiple of 0.5 wavelength.

5. The dual gain radio antenna according to claim 1, wherein said antenna has a higher gain when said second antenna element is in said in said extended position as compared to when said second antenna element is in said retracted position.

6. The dual gain radio antenna according to claim 1, wherein said sensor is a switch.

7. The dual gain radio antenna according to claim 6, wherein a portion of said second antenna element engages said switch, to automatically transfer said switch from a first position to a second position when said second antenna element is moved between said retracted position and said extended position.

8. The dual gain radio antenna according to claim 1, wherein said matching system couples a first impedance matching network to said antenna when said second antenna element is in said retracted position, and couples a second impedance matching network to said antenna when said second antenna element is in said extended position.

9. The dual gain radio antenna according to claim 8, wherein said matching system modifies said first impedance matching network to provide said second impedance matching network.

10. The dual gain radio antenna according to claim 1, wherein said impedance matching network is connected to a feed line of said antenna located substantially at a base of said helically shaped conductor.

11. The dual gain radio antenna according to claim 1, wherein said second antenna element is a whip antenna element.

12. The dual gain radio antenna according to claim 1, wherein said rod is made of a flexible material.

13. A dual gain radio antenna, comprising a first elongated antenna element;

a second elongated antenna element disposed within an axial bore of said first elongated antenna element, said second elongated antenna element movable between a retracted position and an extended position, a larger length of said second elongated antenna element extending from said bore when said second antenna element is in said extended position as compared to said retracted position;

a switch disposed on a portion of said dual gain radio antenna, a state of said switch transferred from a first switch position to a second switch position when said second antenna element is moved between said extended position and said retracted position;

a matching system and a relay controlling said matching system, all disposed within a portion of said dual gain radio antenna and responsive to said switch, said matching system including an impedance matching circuit for said dual gain radio antenna, said impedance matching circuit providing an impedance match for an RF source;

a contact element disposed on a portion of said second elongated antenna element and positioned to form an electrical connection between said first elongated antenna element and said second elongated antenna element when said second elongated antenna element is in said extended position; and means for removably coupling said dual gain radio antenna to a portable communications device.

* * * * *